United States Patent [19]

Vadik et al.

[11] 3,946,519

[45] Mar. 30, 1976

[54] METHOD AND APPARATUS FOR CONSTRUCTING A TOSS-TYPE FLYING DEVICE

[75] Inventors: George Vadik; Maury Balkan, both of Chicago, Ill.

[73] Assignee: Marketing Techniques, Inc., Chicago, Ill.

[22] Filed: Aug. 2, 1974

[21] Appl. No.: 494,322

[52] U.S. Cl. ..... 46/79; 244/153 R

[51] Int. Cl.[2] ..... A63H 27/00

[58] Field of Search ..... 46/79; 244/153

[56] References Cited

UNITED STATES PATENTS

| | | | |
|---|---|---|---|
| 2,727,752 | 3/1960 | Jordan | 244/153 R |
| 3,010,246 | 11/1961 | England | 46/1 L |

OTHER PUBLICATIONS

Great American Paper Airplane Book, Copyrighted 1967, plane 18.

*Primary Examiner*—Louis G. Mancene
*Assistant Examiner*—Robert F. Cutting
*Attorney, Agent, or Firm*—Alter and Weiss

[57] ABSTRACT

A toss-type flying device which can be easily assembled from a pair of rectangular strips of material, two rubber bands, and an ordinary drinking straw. The pair of rectangular strips are manually formed into circular aerodynamic members, which are attached to either end of the drinking straw by the rubber bands. It is contemplated that the rectangular strips and rubber bands will be furnished as a premium to a customer purchasing a soft drink with a straw, such that the customer can readily and manually construct the toy flying device.

8 Claims, 12 Drawing Figures

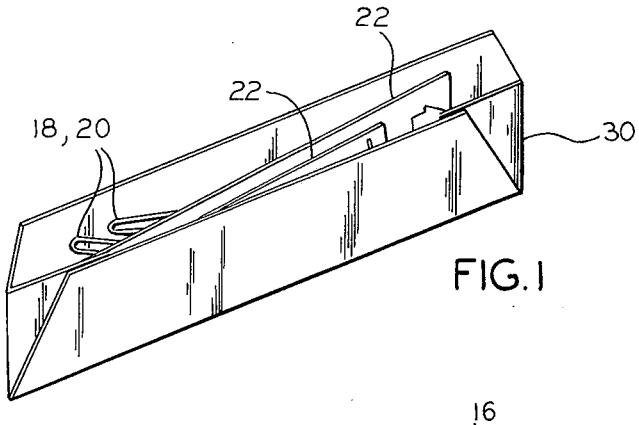
FIG. 1
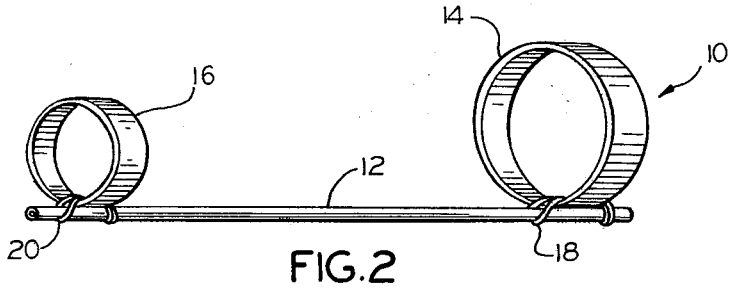
FIG. 2
FIG. 3
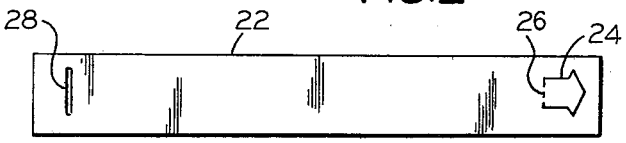
FIG. 4
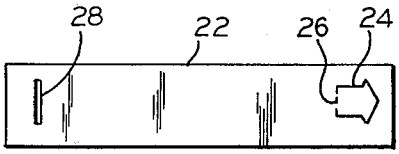
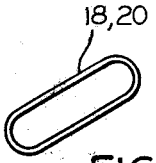
FIG. 5
FIG. 6
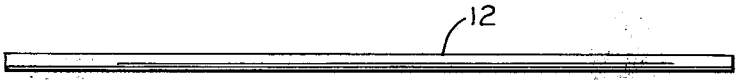
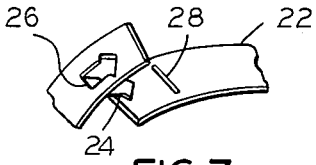
FIG. 7
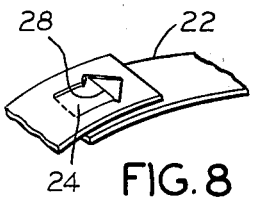
FIG. 8
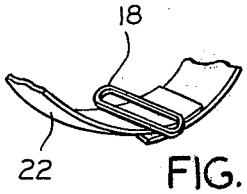
FIG. 9
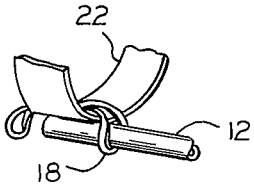
FIG. 10
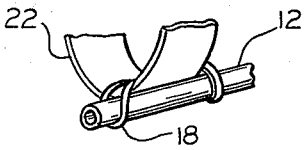
FIG. 11
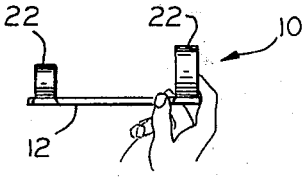
FIG. 12

METHOD AND APPARATUS FOR CONSTRUCTING A TOSS-TYPE FLYING DEVICE

The present invention relates to a toss-type toy flying apparatus, and the method of making same. In particular, my invention relates to an apparatus and method of producing a toy flying apparatus from a pair of rectangular formed strips of sheet material, two rubber bands, and a common drinking straw.

It has been known for many years that toss-type toy flying devices such as airplanes, rockets, or the like can be fabricated from paper or cardboard pieces, folded and assembled into various sorts of aerodynamic configurations. These flying devices are designed to be manually launched into the air, where the direction and force of launch, prevailing wind currents, and ratio of lift to weight of the apparatus determines the distance the device travels and the length of time the device is able to remain aloft.

One type of toy flying apparatus previously available consists of a pair of circular aerodynamic members permanently formed and fixed to a longitudinal fuselage member. To fabricate this toy, one needs materials to cut the pieces to shape, plus glue or a similar adhesive to bond the ends of the aerodynamic members together. Therefore, presently available toy flying devices of the type previously mentioned are not adapted to be given away as premium items to retail consumers who can readily construct or assemble a toy airplane or rocket.

The present invention contemplates an apparatus and method for providing several individual elements which, when affixed to an ordinary drinking straw and properly assembled, comprise a toy flying apparatus. Two rectangular strips of paper or cardboard are properly scored and perforated to enable the pieces to be joined at their ends to form circular aerodynamic elements. These pieces of paper or cardboard, along with two rubber bands, are furnished as a premium to purchasers of a soft drink in a food service establishment, such as a fast food service restaurant. Instructions are provided for forming the cardboard or paper pieces into circular aerodynamic elements, and for using the rubber bands to removably affix these elements to the drinking straw obtained with the purchase of the soft drink. By using my novel method of assembly, a complete toss-type toy flying apparatus can be easily and economically constructed.

Accordingly, it is an object of the present invention to provide a toy flying apparatus which can be readily assembled by hand.

Still another object of my invention is to provide a toss-type toy flying apparatus which can be assembled from a few simple rectangular strips of sheet material and an ordinary drinking straw.

A further object of my invention is to provide a toss-type toy flying apparatus which can partially be offered as a premium in a food service establishment to a purchaser of a soft drink, whereby the construction of the flying apparatus is completed by attaching the parts furnished to an ordinary drinking straw.

yet another object of my invention is to provide a method of constructing a toy flying apparatus by removably affixing a pair of circular aerodynamic members to a longitudinal member using rubber bands.

A still further object of my invention is to provide a toss-type toy flying device which can economically and easily be constructed from ordinarily available materials.

Other objects and advantages of the invention will become apparent from the following description when read in conjunction with the accompanying drawings in which:

FIG. 1 is a perspective view of a package containing the materials necessary for construction of the flying device of the present invention, less an ordinary drinking straw which is obtained when a soft drink or beverage is purchased;

FIG. 2 is an elevation view of a flying device completely assembled in accordance with the teachings of my invention;

FIGS. 3 and 4 are detail views of the sheet material strips from which the aerodynamic members of my flying device are constructed;

FIG. 5 is a detail view of a rubber band such as used in the assembly of my toy flying device;

FIG. 6 is a view of an ordinary drinking straw; and

FIGS. 7 through 12 illustrate the method of assembling the toss-type toy flying device in accordance with my invention.

Referring to FIG. 2, the toss-type toy flying apparatus of my invention is generally designated by the numeral 10. The apparatus 10 includes a longitudinally extending fuselage member 12 having first and second circular formed aerodynamic members 14, 16 removably affixed to each end of the fuselage. Fuselage 12 is preferrably a cylindrical shaft or rod, being hollow in its central portion. In the preferred embodiment, fuselage 12 is formed from an ordinary drinking straw, such as supplied to a customer who purchases a soft drink or beverage in a food service establishment.

One of the circular formed aerodynamic members 14 is larger in diameter than the other, 16, to provide an aerodynamic device capable of soaring through the air when launched or tossed. Each circular formed member 14, 16 is removably affixed to fuselage 12 by placing a portion of the outer surface of each member 14, 16 near an end of fuselage 12, and using rubber bands 18, 20 to maintain the members 14, 16 in their proper position. Each rubber band is looped around the fuselage 12 on one side of an adjacent member 14, 16, then extended over an interior portion of each respective aerodynamic member, and looped around the fuselage 12 on the other side of each aerodynamic member.

Each circular formed aerodynamic member 14, 16 is formed from a rectangular strip of sheet material 22 (FIGS. 3 and 4), such as paper, cardboard, or the like, which is approximately equal in length to the circumferential distance of each aerodynamic member 14, 16 less the amount of overlapping material necessary to maintain each aerodynamic member in its circular configuration. Strips 22 include an arrow-shaped tounge or cut-out 24 which remains adhered to each strip 22 along line 26. The opposite end of each strip of sheet material 22 comprises a slit 28 approximately equal in length to the broad dimention of arrow-shaped cut-out 24.

Each circular formed aerodynamic member 14, 16 is constructed by bring each end together as shown in FIG. 7 and inserting cut-out 24 into slit 28. The fit between cut-out 24 and slit 28 is sufficient to maintain the circular configuration of the strips 22 of sheet material. The same method is used to form both aerodynamic members 14 and 16.

Referring to FIGS. 7 and 12, to construct the toss-type toy flying apparatus of my invention, each aerodynamic member 14, 16 is formed as described above, and a portion of the exterior surface of each member is located near the opposite ends of fuselage 12. A small portion of the fuselage extends beyond its adjacent aerodynamic member 14, 16.

As shown in FIG. 10, a rubber band 18 is laid across a first aerodynamic member and first looped around the fuselage adjacent the interior side of aerodynamic member 14. Next, the rubber band is passed or extended across the interior surface of member 14, and looped around the end of fuselage 12 extending beyond the aerodynamic member. The same method is used to affix the second aerodynamic member 16 to fuselage 12. The aerodynamic members can be removed from fuselage 12 by merely disengaging rubber bands 18, 20. Each aerodynamic member 14, 16 can also be reformed into a flat rectangular strip of sheet material by disengaging cut-out 24 from slit 28.

Part of my inventive concept includes furnishing two rectangular pieces of sheet material 22 and two rubber bands 18, 20 in a packet 30 (FIG. 1) to purchasers of a soft drink or beverage in a food service establishment. The customer is supplied with a drinking straw with the beverage, and upon finishing the soft drink, can manually assemble the above disclosed toy flying apparatus from the strips of sheet material and rubber bands.

It should be understood that while I have described and illustrated a preferred embodiment of my invention in connection with a specific apparatus, it is to be clearly understood that this description is made only by way of example, and not as a limitation on the scope of my invention.

Thus, having described my invention, I claim:

1. A toss-type flying apparatus comprising:

a longitudinally extending cylindrical fuselage member;

a first circular formed aerodynamic member removably affixed to one end of said fuselage member;

a second circular formed aerodynamic member removably affixed to the other end of said fuselage member;

said first and second aerodynamic members each affixed to said cylindrical fuselage member by looping a rubber band around said fuselage, extending said rubber band over a portion of said member, and looping said rubber band around said fuselage on the other side of said member.

2. The toy flying apparatus of claim 1 wherein said cylindrical fuselage member comprises an ordinary drinking straw.

3. The toy flying apparatus of claim 1 wherein each of said first and second aerodynamic members are formed by joining the ends of a rectangular strip of sheet material subsequent to bending said strip into a circular configuration.

4. The toy flying apparatus of claim 3 including mating tounge and slit means on opposite mating ends of each said strip of sheet material to permit said material to be manually assembled and held in said circular configuration.

5. The toy flying apparatus of claim 1 wherein said first and second circular formed aerodynamic members are of different diameters.

6. The method of constructing a toss-type toy flying apparatus comprising the steps of:

forming two circular aerodynamic members from strips of rectangular sheet material; and affixing an exterior portion of each circular aerodynamic member to an end of a longitudinal cylindrical fuselage by locating said aerodynamic member near an end of said cylindrical fuselage member, looping a rubber band around said fuselage member, passing said rubber band over an interior surface of said aerodynamic member, and looping said rubber band around an adjacent end of said cylindrical fuselage member.

7. The method of claim 6 wherein the step of forming said two circular aerodynamic members includes removably inserting a tongue disposed adjacent one end of said sheet material thorugh a mating slit adjacent the other end of said sheet material.

8. The method of claim 6 wherein said cylindrical fuselage member is an ordinary drinking straw.

* * * * *